US006572292B2

(12) United States Patent
Kelley et al.

(10) Patent No.: US 6,572,292 B2
(45) Date of Patent: Jun. 3, 2003

(54) APPARATUS AND METHOD FOR TRANSPORTING PRINT MEDIA THROUGH A PRINTZONE OF A PRINTING DEVICE

(75) Inventors: Richard A. Kelley, Vancouver, WA (US); Bruce G. Johnson, Ridgefield, WA (US); Michael W. Munro, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 09/849,124

(22) Filed: May 4, 2001

(65) Prior Publication Data

US 2002/0164191 A1 Nov. 7, 2002

(51) Int. Cl.[7] ..... B41J 13/10; B41J 13/22

(52) U.S. Cl. ..... 400/627; 400/648; 400/656; 271/276

(58) Field of Search ..... 400/648, 649, 400/655, 656, 635, 627; 271/276; 347/104

(56) References Cited

U.S. PATENT DOCUMENTS 5,216,442 A * 6/1993 Parks et al. ..... 346/104
5,992,973 A * 11/1999 Wen ..... 347/19
6,152,444 A 11/2000 Elgee et al. ..... 271/266
2001/0015746 A1 * 8/2001 Yosimura et al. ..... 347/102

FOREIGN PATENT DOCUMENTS

GB 2177067 A * 1/1987 ..... B65H/20/00
GB 2238759 A * 6/1991 ..... B41J/13/08
JP 08072337 A * 3/1996 ..... B41J/11/02
JP 2000198576 A * 7/2000 ..... B41J/13/02

OTHER PUBLICATIONS

Machine Translation of JP 2000–198576 from Japanese Patent Office Website.*

* cited by examiner

*Primary Examiner*—Daniel J. Colilla
(74) *Attorney, Agent, or Firm*—Erik A. Anderson

(57) ABSTRACT

An apparatus for transporting print medium through a printzone of a printing device. The apparatus including a print media movement mechanism configured to advance a first portion of a print medium through the printzone and a reciprocally translating vacuum platen downstream of the print media movement mechanism. The vacuum platen receives the print medium and conveys a remaining portion of the print medium through the printzone so that a printing mechanism can print at a bottom margin of the print medium.

22 Claims, 5 Drawing Sheets

APPARATUS AND METHOD FOR TRANSPORTING PRINT MEDIA THROUGH A PRINTZONE OF A PRINTING DEVICE

BACKGROUND AND SUMMARY

The present invention relates to printing devices. More particularly, the present invention relates to an apparatus and method for transporting print media through a printzone of a printing device.

Printing devices, such as inkjet printers and laser printers, use printing composition (e.g., ink or toner) to print images (text, graphics, etc.) onto a print medium in a printzone of the printing device. Inkjet printers may use print cartridges, also known as "pens", which deposit printing composition, referred to generally herein as "ink", onto a print medium such as paper, labels, forms, or transparencies. Each pen has a printhead that includes a plurality of nozzles. Each nozzle has an orifice through which the printing composition is ejected. To print an image, the printhead is propelled back and forth across the print medium by, for example, a carriage while ejecting printing composition in a desired pattern as the printhead moves. The particular ink ejection mechanism within the printhead may take on a variety of different forms known to those skilled in the art, such as thermal printhead technology. For thermal printheads, the ink may be a liquid, with dissolved colorants or pigments dispersed in a solvent.

Printing near the bottom margin of a print medium being transported through a printzone of a printing device can be difficult. Vacuum platens in the printzone have been proposed and implemented as a means for controlling print medium flatness in the printzone. These designs employ a fixed vacuum platen which did not address bottom margin printing performance. Vacuum belts and drums have been proposed to control print media shape and improve bottom margin printing performance. These solutions are expensive, however, because of the materials needed for the belt or drum and the large motors required to pull the belt over a vacuum zone or rotate the drum.

Star rollers are a proposed solution for improved bottom margin printing performance. These star rollers do not employ the use of a vacuum belt or drum. The star rollers are located downstream of the drive rollers, pinch rollers, and printzone. These star rollers pull a print medium through the printzone so that the printing can occur near the bottom margin of print media. Problems exist, however, with the use of star rollers. Star rollers can cause permanent damage by punching holes through a print medium. Additionally, star rollers can smear images on a print medium where they come into contact with the images. Furthermore, print medium line feed artifacts can occur as the drive rollers and pinch rollers, which push print media through the printzone, handoff transport of print media to the star rollers, which pull print media through the printzone.

An apparatus and method directed to these above-described problems associated with bottom margin printing would be a welcome improvement. Accordingly, the present invention is directed to an apparatus and method for transporting print media through a printzone of a printing device that addresses the above-described problems associated with bottom margin printing.

An embodiment of an apparatus in accordance with the present invention for transporting print media through a printzone of a printing device includes a print media movement mechanism configured to advance a first portion of a print medium through the printzone. The apparatus additionally includes a translating vacuum platen downstream of the print media movement mechanism to receive the print medium and configured to convey a remaining portion of the print medium through the printzone.

The above-described embodiment of an apparatus in accordance with the present invention may be modified and include at least the following characteristics, as described below. The print media movement mechanism may include at least one drive roller and at least one pinch roller. The translating vacuum platen may include a solenoid drive mechanism. Alternatively, the translating vacuum platen may include a cam drive mechanism. As another possible alternative, the translating vacuum platen may include a rack and pinion drive mechanism. As a further possibility, the translating vacuum platen may include a pneumatic cylinder drive mechanism.

An embodiment of a method in accordance with the present invention for use in a printing device having a printzone in which printing composition is deposited on print media includes advancing a first portion of a print medium through the printzone. The method additionally includes acquiring the print medium via a vacuum hold-down force. The method further includes translating a remaining portion of the print medium through the printzone via the vacuum hold-down force to enable deposition of printing composition at a bottom margin of the print medium.

An alternative embodiment of a method in accordance with the present invention for use in a printing device having a printzone includes transporting a first portion of a print medium through the printzone. The method also includes printing on the first portion of the print medium. The method additionally includes releasing the print medium subsequent to printing on the first portion. The method further includes conveying a remaining portion of the print medium through the printzone and printing on the remaining portion of the print medium.

An alternative embodiment of an apparatus in accordance with the present invention for use in a printing device having a printzone includes a drive roller and a pinch roller mechanism configured to transport a print medium through the printzone. The apparatus additionally includes a vacuum platen positioned in the printzone of the printing device to receive the print medium from the drive roller and pinch roller mechanism. The apparatus further includes a drive mechanism coupled to the vacuum platen to translate the vacuum platen and print medium thereon to enable printing at a bottom margin of the print medium.

The above-described alternative embodiment of an apparatus in accordance with the present invention may be modified and include at least the following characteristics, as described below. The drive mechanism may include a solenoid. Alternatively, the drive mechanism may include a cam. As another possible alternative, the drive mechanism may include a rack and pinion gear. As a further possible alternative, the drive mechanism may include a pneumatic cylinder.

Another alternative embodiment of an apparatus in accordance with the present invention for use in a printing device having a printzone and a printing mechanism for printing on print media includes structure for transporting a first portion of a print medium through the printzone. The apparatus also includes vacuum hold-down structure for acquiring the print medium from the structure for transporting. The apparatus further includes structure for moving the vacuum hold-down structure to convey a remaining portion of the print medium through the printzone so that the printing mechanism can print at a bottom margin of the print medium.

The foregoing summary is not intended by the inventors to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Additionally, it should be noted that the use of the word substantially in this document is used to account for things such as engineering and manufacturing tolerances, as well as variations not affecting performance of the present invention. Other objects, advantages, and novel features of the present invention will become apparent from the following detailed description when considered in conjunction with the accompanying drawings.

DETAILED DESCRIPTION OF THE DRAWINGS

Figure 1:
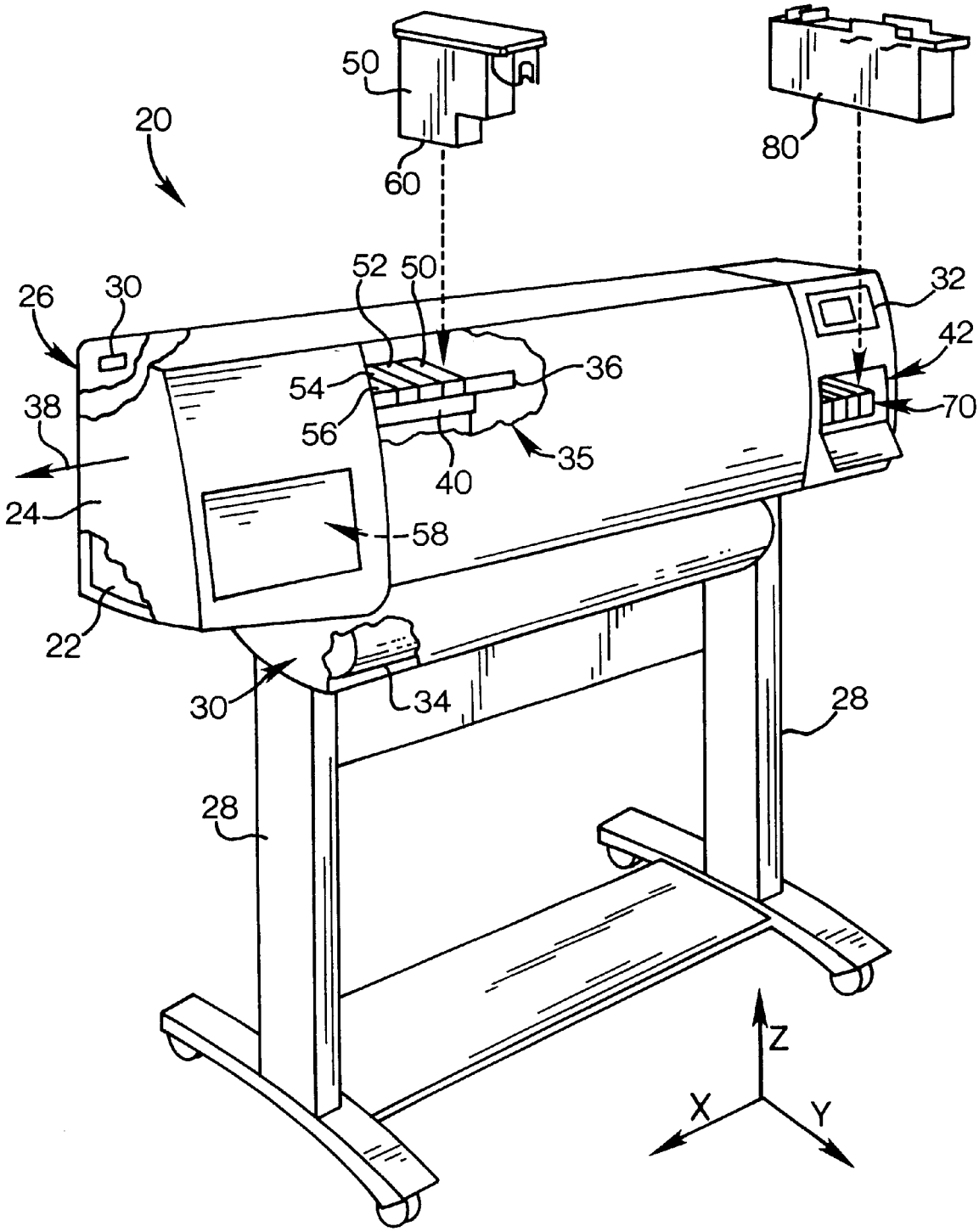
FIG. 1 is a perspective view of a printing device that includes an embodiment of the present invention.

FIG. 1 illustrates an embodiment of a printing device 20, here shown as an inkjet plotter, constructed in accordance with the present invention, which may be used for printing conventional engineering and architectural drawings, as well as high quality poster-sized images, and the like. A variety of inkjet printing devices are commercially available. For instance, some of the printing devices that may include the present invention are desk top printers, portable printing units, office printers, copiers, video printers, photo printers, and facsimile machines, to name a few. For convenience the concepts of the present invention are illustrated in the environment of an inkjet plotter 20.

While it is apparent that the plotter components may vary from model to model, the typical inkjet plotter 20 includes a chassis 22 surrounded by a housing or casing enclosure 24, typically of a plastic material, together forming a print assembly portion 26 of the plotter 20. While it is apparent that the print assembly portion 26 may be supported by a desk or tabletop, it is preferred to support the print assembly portion 26 with a pair of leg assemblies 28. The plotter 20 also has a computing device, illustrated schematically as a microprocessor 30, that receives instructions from a host device, typically a computer, such as a personal computer or a computer aided drafting (CAD) system (not shown). The computing device 30 may also operate in response to user inputs provided through a key pad and status display portion 32, located on the exterior of the casing 24. A monitor coupled to the computer host may also be used to display visual information to an operator, such as the plotter status or a particular program being run on the host computer. Personal and drafting computers, their input devices, such as a keyboard and/or a mouse device, and monitors are all well known to those skilled in the art.

As discussed more fully below, a print media movement mechanism (not shown in FIG. 1) is used to advance a continuous roll of print medium 34 through a printzone 35. The print medium may be any type of suitable roll or individual sheet material, such as paper, poster board, fabric, transparencies, MYLAR brand film, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to control signals received from the computing device 30. To provide carriage positional feedback information to computing device 30, a conventional encoder strip (not shown) may be extended along the length of the printzone 35 and over servicing region 42. A conventional optical encoder reader (not shown) may be mounted on the back surface of printhead carriage 40 to read positional information provided by the encoder strip. The manner of providing positional feedback information via the encoder strip reader, may also be accomplished in a variety of ways known to those skilled in the art. Upon completion of printing an image, carriage 40 may be used to drag a cutting mechanism across the print medium to sever it from the remainder of the roll of print medium 34. Of course, sheet severing may be accomplished in a variety of other ways known to those skilled in the art. Moreover, the illustrated inkjet printing device 20 may also be used for printing images on pre-cut sheets of print media, rather than on a roll.

In the printzone 35, print medium 34 receives printing composition such as ink from a printing mechanism, such as a black ink cartridge 50 and three monochrome color ink cartridges 52, 54 and 56. The cartridges 50–56 are also often called "pens" by those in the art. The black ink pen 50 is illustrated herein as containing a pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in other implementations. It is apparent that other types of inks may also be used in the pens 50–56, such as paraffin-based inks, as well as hybrid or composite inks having both dye and pigment characteristics. The illustrated printing device 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35. As used herein, the term "pen" or "cartridge" may also refer to replaceable printhead cartridges where each pen has a reservoir that carries the entire ink supply as the printhead reciprocates over the printzone.

The illustrated pens 50, 52, 54 and 56 each have a printhead, such as printhead 60 for black pen 50, which selectively ejects ink to form an image on print medium 34 in the printzone 35. The illustrated inkjet printheads have a large print swath, for instance about 20 to 25 millimeters (about one inch) wide or wider, although the printhead maintenance concepts described herein may also be applied to smaller inkjet printheads. The concepts disclosed herein for maintaining and operating these printheads apply equally to the totally replaceable inkjet cartridges, as well as to the illustrated off-axis semi-permanent or permanent printheads.

The printheads, such as printhead 60, each have an orifice plate with a plurality of nozzles formed therethrough in a manner well known to those skilled in the art. The nozzles of each printhead are typically formed in at least one, but typically two substantially linear arrays along the orifice plate, but may include nozzle arrangements offset from one another, for example, in a zigzag arrangement. Each substantially linear array is typically aligned in a longitudinal direction perpendicular to scanning axis 38, with the length of each array determining the maximum image swath for a single pass of the printhead. The illustrated printheads are thermal inkjet printheads, although other types of printheads may be used, such as piezoelectric printheads. Thermal printheads typically include a plurality of resistors which are associated with the nozzles. Upon energizing a selected resistor, a bubble of gas is formed which ejects a droplet of ink from the nozzle onto a print medium in the printzone 35 under the nozzle. The printhead resistors are selectively energized in response to firing command control signals delivered from computing device 30 to printhead carriage 40.

To clean and protect the printheads, a "service station" mechanism 70 is typically mounted within the servicing region 42 of plotter chassis 22 so the printheads can be moved over the station for maintenance. Service station 70 uses four replaceable inkjet printhead cleaner units, such as a black cleaner unit 80, used to service black printhead 60. Each of the cleaner units has an installation and removal handle, which may be gripped by an operator when installing the cleaner units. Following removal, the cleaning units are typically disposed of and replaced with a fresh unit, so the units may also be referred to as "disposable cleaning units," although it may be preferable to return the spent units to a recycling center for refurbishing.

For storage, or during non-printing periods, the cleaning units each have a capping system which seals the printhead nozzles from contaminants and drying. Some caps are also designed to facilitate priming, such as by being connected to a pumping unit or other mechanism that draws a vacuum on the printhead. During operation, clogs in the printheads are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that may have collected on the face of the printhead.

Figure 2:
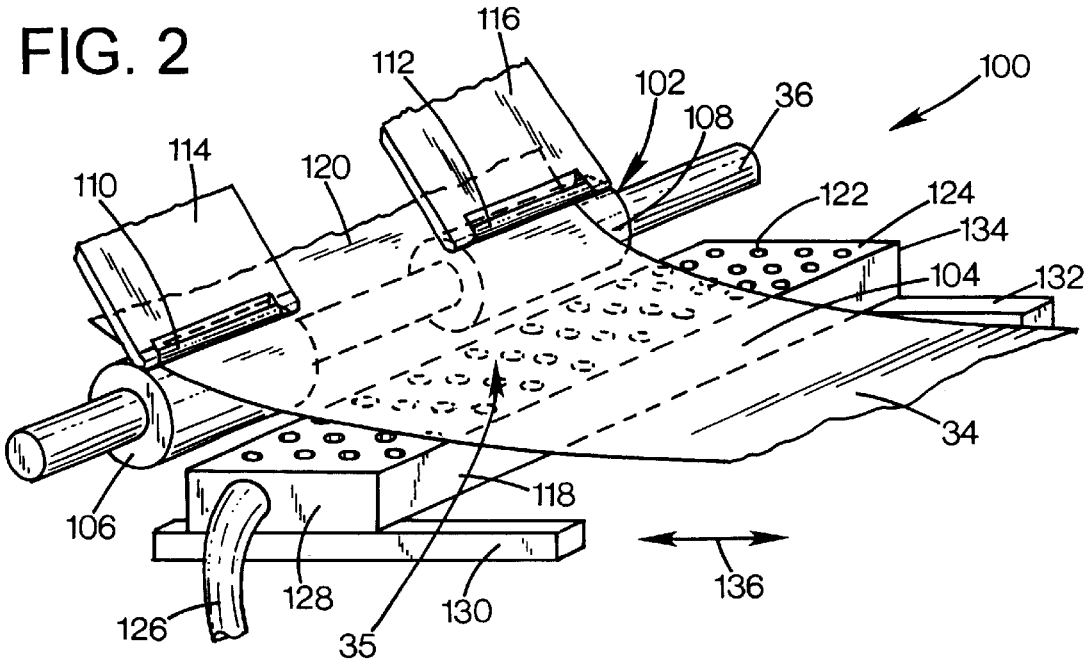
FIG. 2 is a perspective view of an embodiment of print media transport system in accordance with the present invention.

A perspective view of an embodiment of a print media transport system 100 in accordance with the present invention is shown in FIG. 2. Print media transport system 100 includes a print media movement mechanism 102 configured to advance a first portion 104 of print medium 34 through printzone 35. As can be seen in FIG. 2, print media movement mechanism 102 includes drive rollers 106 and 108 and pinch rollers 110 and 112. Pinch rollers 110 and 112 are biased against one surface of print medium 34 by pinch roller brackets 114 and 116. Drive rollers 106 and 108 engage the opposing surface of print medium 34 and cooperate with pinch rollers 110 and 112 to advance first portion 104 of print medium 34 through printzone 35 of printing device 20.

As can be seen in FIG. 2, print media transport system 100 also includes a translating vacuum platen 118 located downstream of print media movement mechanism 102 to receive print medium 34 therefrom. Translating vacuum platen 118 is configured to convey remaining portion 120 of print medium 34 through printzone 35 as more fully discussed below. Translating vacuum platen 118 acquires print medium 34 via a vacuum hold-down force provided by a plurality of apertures 122 through top surface 124 of platen 118. Apertures 122 are fluidly coupled to pipe 126 which extends through end 128 of platen 118. Pipe 126 is in turn coupled to a vacuum source (not shown) which provides the suction through apertures 122 of translating vacuum platen 118.

As can also be seen in FIG. 2, print media transport system 100 includes a pair of rails 130 and 132. Ends 128 and 134 of vacuum platen 118 are moveably coupled to respective rails 130 and 132 so that platen 118 can translate along the lengths of rails 130 and 132 in either of the directions shown by double-headed arrow 136. Various exemplary mechanisms in accordance with the present invention that may be used to move translating vacuum platen along rails 130 and 132 are illustrated and described below in FIGS. 5–11.

Figure 3:
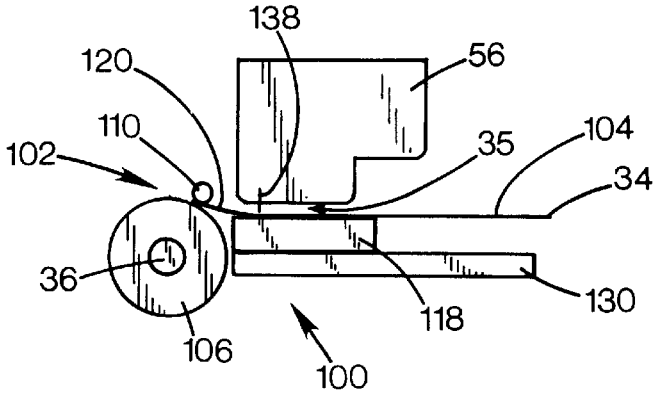
FIG. 3 is a diagram of the operation of the print media transport system in accordance with the present invention.

A diagram of the operation of print media transport system 100 in accordance with the present invention is shown in FIG. 3. As can be seen in FIG. 3, print media movement mechanism 102 has advanced first portion 104 of print medium 34 through printzone 35 to the point generally represented by line 138 in FIG. 3. At this point, print medium 34 is about to exit drive rollers 106 and 108 and pinch rollers 110 and 112. As can be seen in FIG. 3, remaining portion 120 of print medium 34 has not yet entered printzone 35 and is therefore blank. Second portion 120 would normally define the bottom margin of print medium 34 without the use of translating vacuum platen 118 of the present invention because drive rollers 106 and 108 and pinch rollers 110 and 112 lose engagement with print medium 34 and can not advance remaining portion 120 through printzone 35 for printing by pens 50, 52, 54, and 56.

Figure 4:
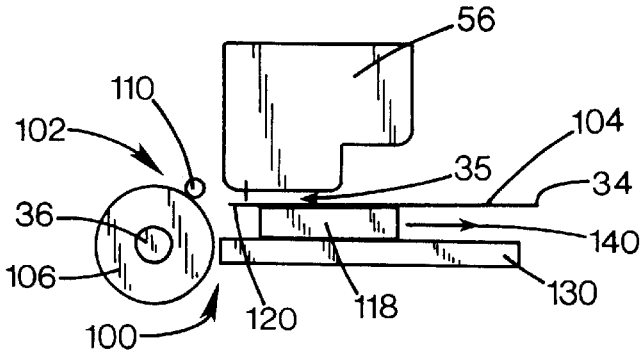
FIG. 4 is another diagram of the operation of the print media transport system in accordance with the present invention.

As print medium 34 exits drive rollers 106 and 108 and pinch rollers 110 and 112, it is acquired by translating vacuum platen 118 via a vacuum hold-down force as shown in FIG. 3. Vacuum platen 118 then translates in the direction generally indicated by arrow 140 in FIG. 4 to convey remaining portion 120 of print medium 34 through printzone 35. This allows deposition of printing composition at the bottom margin or remaining portion 120 of print medium 34.

In accordance with the present invention, vacuum platen 118 also helps maintain proper spacing between print medium 34 and pens 50, 52, 54, and 56. This is accomplished by holding print medium 34 substantially flat against platen 118 via a vacuum hold-down force when traveling through printzone 35. Maintaining this proper spacing helps provide consistent output image quality for printing device 20. Use of a vacuum hold-down force on print medium 34 via platen 118 also helps control cockle growth (print medium buckle toward the printheads) which helps prevent contact between print medium 34 and pens 50, 52, 54, and 56 in printzone 35. Such contact can damage the printheads and typically ruins the image on print medium 34.

Translating vacuum platen 118 may be moved in the directions shown by arrow 136 in FIG. 2 by a variety of different ways in accordance with the present invention. Various exemplary embodiments off these different ways are diagrammatically illustrated below in FIGS. 5–11.

Figure 5:
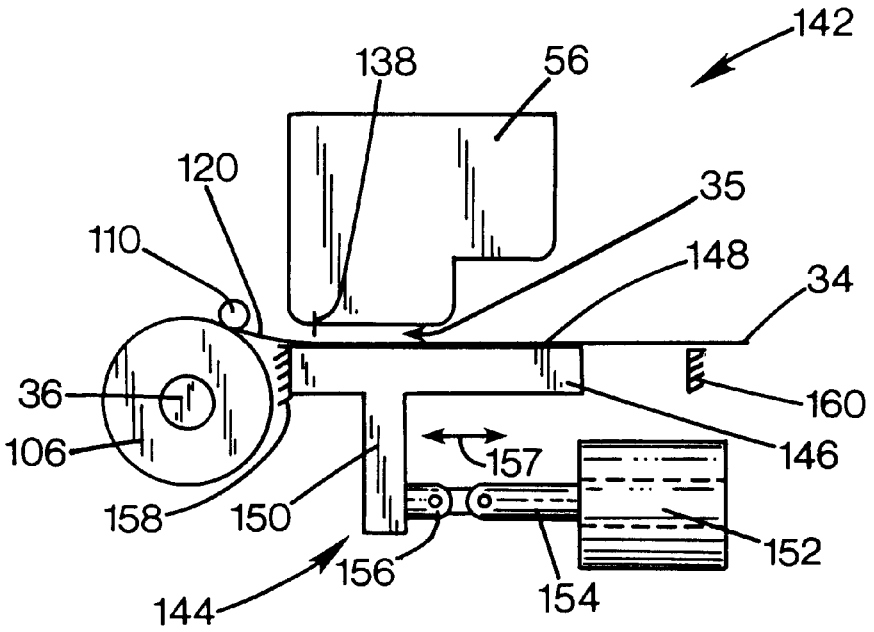
FIG. 5 is a diagram of an embodiment of a pneumatically actuated translating vacuum platen in accordance with the present invention.
Figure 6:
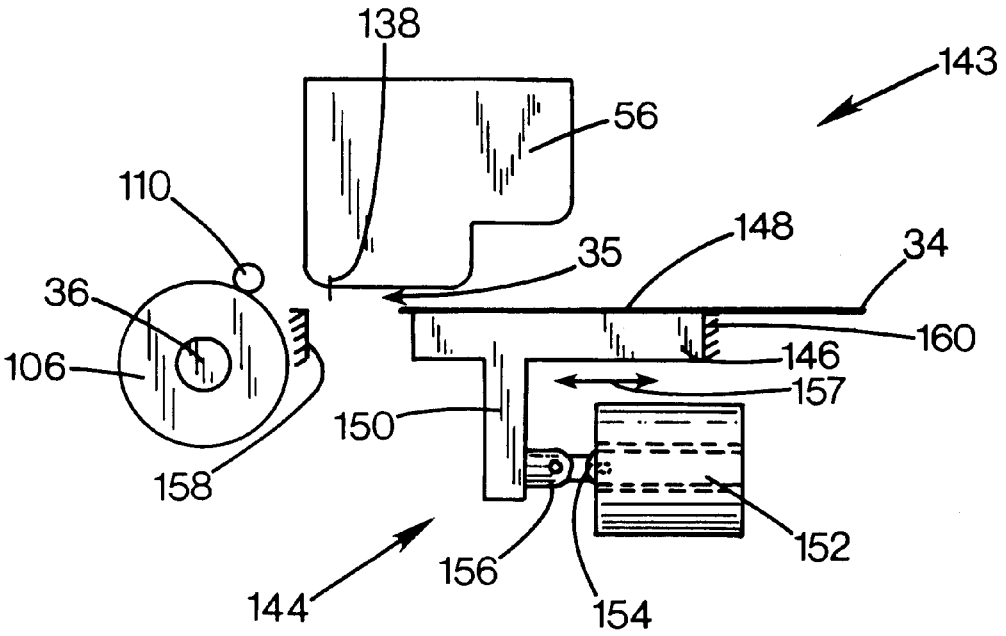
FIG. 6 is an additional diagram of the pneumatically actuated translating vacuum platen of FIG. 5 in another position.

Diagrams 142 and 143 of an embodiment of a pneumatically actuated translating vacuum platen 144 in accordance with the present invention are shown in FIGS. 5 and 6. As can be seen in FIG. 5, pneumatically actuated translating vacuum platen 144 includes a vacuum platen 146 that has acquired print medium 34. Vacuum platen 146 has a top surface 148 with a plurality of apertures (not shown), like apertures 122 in top surface 124 of translating vacuum platen 118 of FIGS. 1–3, that are fluidly coupled to a vacuum source (also not shown). Vacuum platen 146 also includes a depending member 150 connected to or integrally formed with top surface 148.

As can also be seen in FIGS. 5 and 6, pneumatically actuated translating vacuum platen 144 also includes a drive mechanism in the form of a pneumatic cylinder 152 that has a moveable arm 154 coupled to a linkage 156 on depending member 150. Computing device 30 is coupled to pneumatic cylinder 152 to control movement of arm 154 in either of the directions indicated by double-headed arrow 157. This movement of arm 154 in turn causes vacuum platen 146 to move between stops 158 and 160. In this manner, remaining portion 120 of print medium 34 is conveyed through printzone 35 so that pens 50, 52, 54, and 56 of the printing mechanism of printing device 20 can deposit printing composition at the bottom margin or remaining portion 120 of print medium 34.

Figure 7:
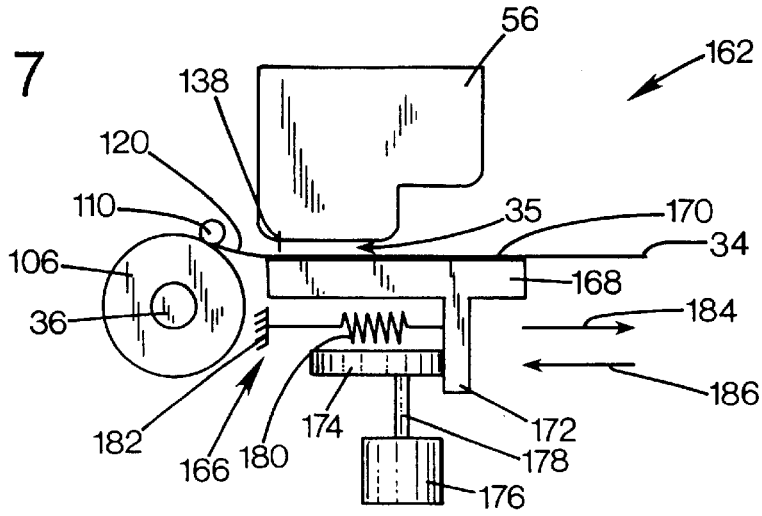
FIG. 7 is a diagram of an embodiment of a cam actuated translating vacuum platen in accordance with the present invention.
Figure 8:
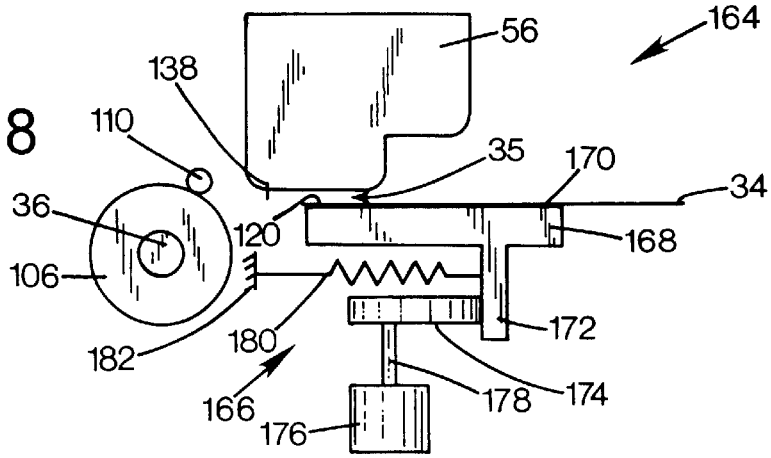
FIG. 8 is an additional diagram of the cam actuated translating vacuum platen of FIG. 7 in another position.

Diagrams 162 and 164 of an embodiment of a cam actuated translating vacuum platen 166 in accordance with the present invention are shown in FIGS. 7 and 8. As can be seen in FIG. 7, cam actuated translating vacuum platen 166 includes a vacuum platen 168 that has acquired print medium 34. Vacuum platen 168 has a top surface 170 with a plurality of apertures (not shown), like apertures 122 in top surface 124 of translating vacuum platen 118 of FIGS. 1–3, that are fluidly coupled to a vacuum source (also not shown). Vacuum platen 168 also includes a depending member 172 connected to or integrally formed with top surface 170.

As can also be seen in FIGS. 7 and 8, cam actuated translating vacuum platen 166 also includes a drive mechanism in the form of a cam 174 coupled to motor 176 via a shaft 178. Cam actuated translating vacuum platen 166 further includes a resilient member 180, such as a spring, coupled on one end to a stationary member 182 and on the other end to depending member 172. Resilient member 180 helps bias depending member 172 against cam 174 so that rotation of cam 174 causes movement of translating vacuum platen 166 as discussed more fully below.

Computing device 30 is coupled to motor 176 to control actuation thereof which causes shaft 178 to rotate. Rotation of shaft 178 causes cam 174 to rotate toward the position shown in FIG. 8 which in turn moves translating vacuum platen 168 in the direction of arrow 184 toward the final position shown in FIG. 8. In this manner, remaining portion 120 of print medium 34 is conveyed through printzone 35 so that pens 50, 52, 54, and 56 of the printing mechanism of printing device 20 can deposit printing composition at the bottom margin or remaining portion 120 of print medium 34. Once in the final position shown in FIG. 8, continued rotation of shaft 178 will cause vacuum platen 168 to move in the direction of arrow 186, ultimately returning it to the position shown in FIG. 7 to receive additional print medium 34.

Figure 9:
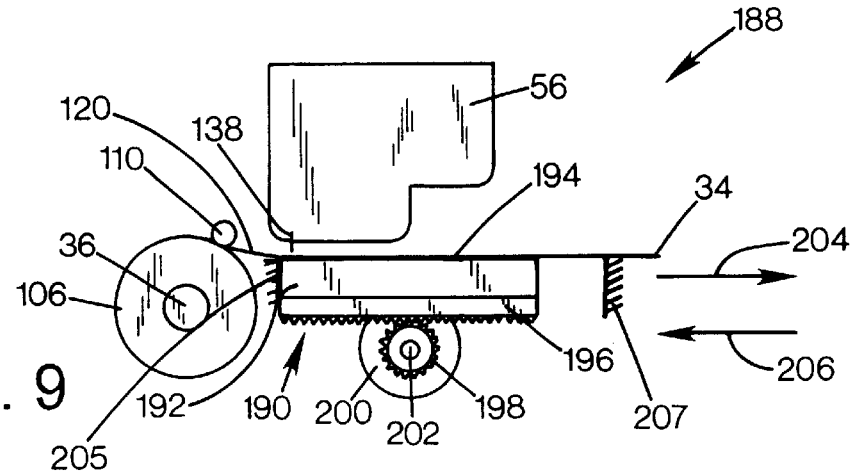
FIG. 9 is a diagram of an embodiment of a rack-and-pinion actuated translating vacuum platen in accordance with the present invention.

A diagram 188 of an embodiment of a rack-and-pinion actuated translating vacuum platen 190 in accordance with the present invention is shown in FIG. 9. As can be seen in FIG. 9, rack-and-pinion actuated translating vacuum platen 190 includes a vacuum platen 192 that has acquired print medium 34. Vacuum platen 192 has a top surface 194 with a plurality of apertures (not shown), like apertures 122 in top surface 124 of translating vacuum platen 118 of FIGS. 1–3, that are fluidly coupled to a vacuum source (also not shown).

As can also be seen in FIG. 9, rack-and-pinion actuated translating vacuum platen 190 also includes drive mechanism in the form of a rack 196 connected to or integrally formed with top surface 194 and a pinion gear 198 meshed with rack 196 and coupled to motor 200 via a shaft 202. Computing device 30 is coupled to motor 200 to control actuation thereof which causes shaft 202 to rotate in either a clockwise or counter-clockwise direction. Rotation of shaft 202 in a clockwise direction causes pinion gear 198 to also rotate in a clockwise direction which in turn moves translating vacuum platen 192 in the direction of arrow 204 shown in FIG. 8. In this manner, remaining portion 120 of print medium 34 is conveyed through printzone 35 so that pens 50, 52, 54, and 56 of the printing mechanism of printing device 20 can deposit printing composition at the bottom margin or remaining portion 120 of print medium 34. Rotation of shaft 202 in a counter-clockwise direction causes pinion gear 198 to also rotate in a counter-clockwise direction which in turn moves translating vacuum platen 192 in the direction of arrow 206 shown in FIG. 8, ultimately returning it to the position shown in FIG. 9 to receive additional print medium 34. Stop 207 limits travel of vacuum platen 192 in the direction of arrow 204 and stop 205 limits travel of vacuum platen 192 in the direction of arrow 206.

Figure 10:
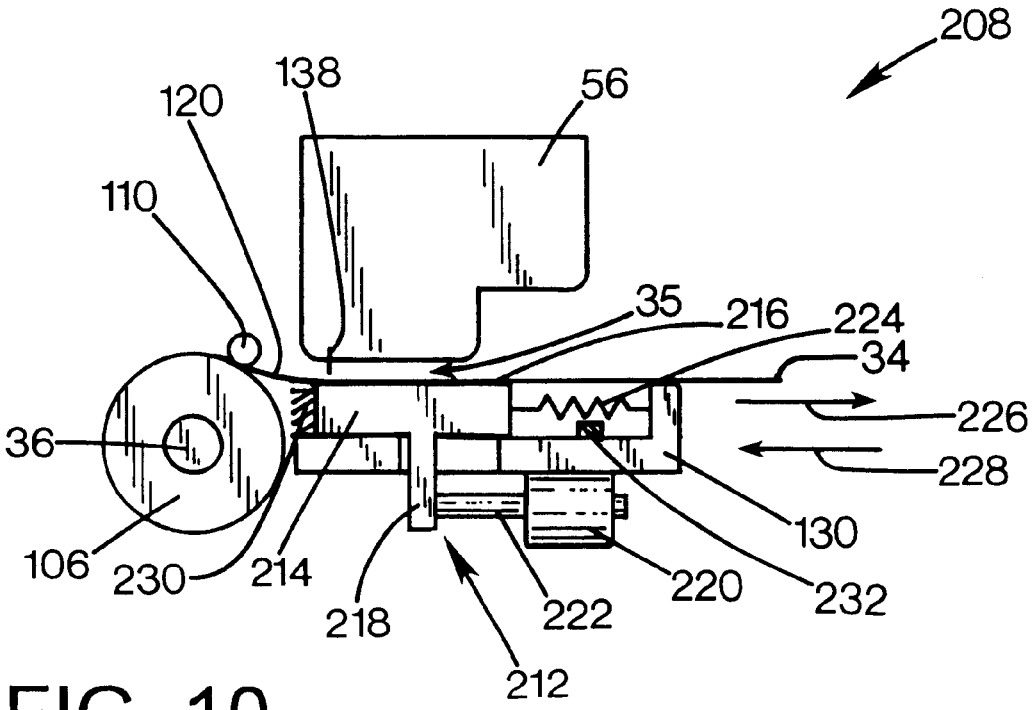
FIG. 10 is a diagram of an embodiment of a solenoid actuated translating vacuum platen in accordance with the present invention.
Figure 11:
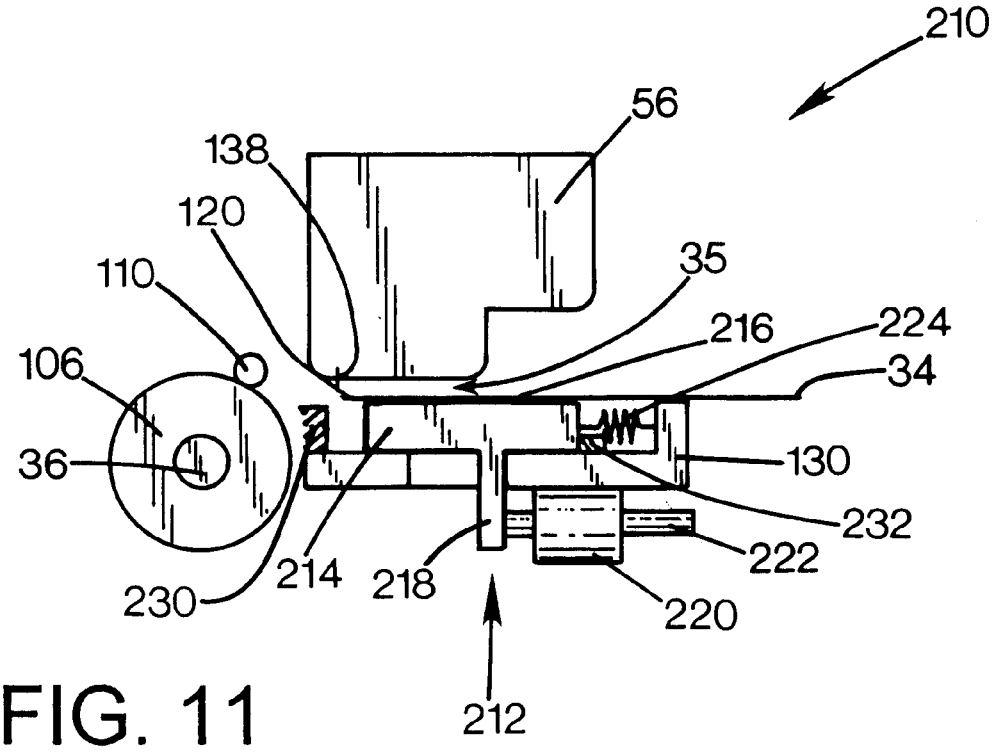
FIG. 11 is an additional diagram of the solenoid actuated translating vacuum platen of FIG. 10 in another position.

Diagrams 208 and 210 of an embodiment of a solenoid actuated translating vacuum platen 212 in accordance with the present invention are shown in FIGS. 10 and 11. As can be seen in FIG. 10, solenoid actuated translating vacuum platen 212 includes a translating vacuum platen 214 that has acquired print medium 34. Vacuum platen 214 has a top surface 216 with a plurality of apertures (not shown), like apertures 122 in top surface 124 of translating vacuum platen 118 of FIGS. 1–3, that are fluidly coupled to a vacuum source (also not shown). Vacuum platen 214 also includes a depending member 218 connected to or integrally formed with top surface 216.

As can also be seen in FIGS. 10 and 11, solenoid actuated translating vacuum platen 212 also includes a solenoid 220 that has a moveable rod 222 coupled to depending member 218. Solenoid actuated translating vacuum platen 212 further includes a resilient member 224, such as a spring, coupled on one end to vacuum platen 214 and on the other end to rail 130.

Computing device 30 is coupled to solenoid 220 to control movement of rod 222 which in turn moves translating vacuum platen 214 in the direction of arrow 226 toward the final position shown in FIG. 11. In this manner, remaining portion 120 of print medium 34 is conveyed through printzone 35 so that pens 50, 52, 54, and 56 of the printing mechanism of printing device 20 can deposit printing composition at the bottom margin or remaining portion 120 of print medium 34. Once in the final position shown in FIG. 11, solenoid 220 is reset and resilient member 224 causes vacuum platen 214 to move in the direction of arrow 228, ultimately returning it to the position shown in FIG. 10 to receive additional print medium 34. Stop 232 limits travel of vacuum platen 214 in the direction of arrow 226 as shown in FIG. 11 and stop 230 limits travel of vacuum platen 214 in the direction of arrow 228 as shown in FIG. 10.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiments disclosed. Modifications and variations may well be apparent to those skilled in the art. For example, in an alternative embodiment of the present invention, cam actuated translating vacuum platen 166 may include a pair of stops, like stops 158 and 160 of FIGS. 5 and 6, that limit the travel of vacuum platen 168. In such cases, the shape of cam 174 does not need to be as precisely controlled as when stops are not used. As another example, in alternative embodiments of the present invention, the translating vacuum platen may be moved with existing printing device mechanisms and motors (e.g., the drive motor for carriage 40, the drive motor for rollers 106 and 108 or the drive motor for service station mechanism 70) rather than through separate additional means as exemplarily shown in FIGS. 5–11. As a further example, encoder feedback systems may be used in each of the embodiments of the present invention disclosed herein, to more accurately control movement of the translating vacuum platen. For example, rack-and-pinion actuated vacuum platen 190 may be equipped with a biasing member, such as a spring, and an optical encoder about shaft 202 to provide more precise stepwise positioning of vacuum platen 192 in printzone 35. Such a system would allow for multipass printing on print medium 34. Use of a biasing member presses the teeth of rack 196 and pinion gear 198 together to help take-up any slack between them which might otherwise manifest itself as line feed errors in the images of printing device 20.

Any method elements described may be interchangeable with other method elements in order to achieve the same result. The spirit and scope of the present invention are to be limited only by the terms of the following claims. Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112, sixth paragraph, unless the element is expressly recited using the phrase "means for . . . ".

What is claimed is:

1. An apparatus for transporting print media through a printzone of a printing device, comprising: a print media movement mechanism configured to advance a first portion of a print medium through the printzone; and a reciprocally translating vacuum platen downstream of the print media movement mechanism to receive the print medium and configured to convey a remaining portion of the print medium through the printzone.

2. The apparatus of claim 1, wherein the print media movement mechanism includes at least one drive roller and at least one pinch roller.

3. The apparatus of claim 1, wherein the translating vacuum platen includes a solenoid drive mechanism.

4. The apparatus of claim 1, wherein the translating vacuum platen includes a cam drive mechanism.

5. The apparatus of claim 1, wherein the translating vacuum platen includes a rack and pinion drive mechanism.

6. The apparatus of claim 1, wherein the translating vacuum platen includes a pneumatic cylinder drive mechanism.

7. A printing device including the apparatus of claim 1.

8. The apparatus of claim 1 including a drive mechanism connected to the vacuum platen for holding the vacuum platen stationary while the first portion of the print medium is advanced through the printzone and for thereafter reciprocally translating the vacuum platen.

9. A method for use in a printing device having a printzone in which printing composition is deposited on print media, the method comprising: advancing a first portion of a print medium through the printzone and across a stationary platen; acquiring the print medium via a vacuum hold-down force; and moving the platen for translating a remaining portion of the print medium through the printzone via the vacuum hold-down force to enable deposition of printing composition at a bottom margin of the print medium.

10. An apparatus for use in a printing device having a printzone, comprising: a roller mechanism configured to transport a print medium through the printzone and across the surface of a vacuum platen that is positioned in the printzone of the printing device to receive the print medium from the roller mechanism; and a drive mechanism coupled to the vacuum platen to translate the vacuum platen and print medium thereon to enable printing at a bottom margin of the print medium.

11. The apparatus of claim 10, wherein the drive mechanism includes a solenoid.

12. The apparatus of claim 10, wherein the drive mechanism includes a cam.

13. The apparatus of claim 10, wherein the drive mechanism includes a rack and pinion gear.

14. The apparatus of claim 10, wherein the drive mechanism includes a pneumatic cylinder.

15. A printing device including the apparatus of claim 10.

16. The apparatus of claim 10 wherein the roller mechanism is configured to transport the print medium across and relative to the surface of the vacuum platen prior to translation of the vacuum platen by the drive mechanism.

17. The apparatus of claim 10 further comprising control means for holding the platen stationary for a time while the print medium is moved across the surface of the vacuum platen.

18. The apparatus of claim 10 wherein the drive mechanism is coupled to the vacuum platen to reciprocally translate the vacuum platen.

19. An apparatus for use in a printing device having a printzone and a printing mechanism for printing on print media, comprising: means for transporting a first portion of a print medium through the printzone; vacuum hold-down means for acquiring the print medium from the means for transporting; and drive means for moving the vacuum hold-down means through the printzone after the first portion of a print medium has been moved through the printzone to convey a remaining portion of the print medium through the printzone so that the printing mechanism can print at a bottom margin of the print medium.

20. A printing device including the apparatus of claim 19.

21. The apparatus of claim 19 wherein the drive means is configured to move the vacuum hold down means back and forth between two stops.

22. The apparatus of claim 19 wherein the vacuum hold down means includes a platen that underlies the print medium and sized to underlie less than all of the print medium.

* * * * *